US005797711A

United States Patent [19]

Mulgrave et al.

[11] Patent Number: 5,797,711

[45] Date of Patent: Aug. 25, 1998

[54] ATTACHING SHEET MATERIAL TO A SUPPORT

[75] Inventors: Mark Doneddu Mulgrave; Frank Tovenati, both of South Oakleigh, Australia

[73] Assignee: W. A. Deutsher Pty. Ltd., Victoria, Australia

[21] Appl. No.: 603,114

[22] Filed: Feb. 20, 1996

[30] Foreign Application Priority Data

Feb. 17, 1995 [AU] Australia ..... PN1192

[51] Int. Cl.[6] ..... B23B 51/00

[52] U.S. Cl. ..... 408/226; 408/239 A; 408/239 R; 81/438; 279/14

[58] Field of Search ..... 7/165, 158; 408/1 R, 408/238, 239 R, 239 A, 225, 226, 224, 228, 211, 227; 279/14; 81/121.1, 438

[56] References Cited

U.S. PATENT DOCUMENTS

| | | | |
|---|---|---|---|
| 2,718,806 | 9/1955 | Clark | 81/438 X |
| 2,752,965 | 7/1956 | Mackey | 408/226 X |
| 3,965,510 | 6/1976 | Ernst | 7/165 |
| 4,107,800 | 8/1978 | Jorgensen | 7/158 |
| 4,218,795 | 8/1980 | Ernst et al. | 7/158 |
| 4,551,875 | 11/1985 | Getz et al. | 7/156 X |
| 4,976,173 | 12/1990 | Yang | 279/14 X |
| 5,452,970 | 9/1995 | Sundstrom et al. | 408/211 |
| 5,499,896 | 3/1996 | Cafarelli | 408/224 X |

FOREIGN PATENT DOCUMENTS

| | | | |
|---|---|---|---|
| 2822372 | 11/1979 | Germany | 7/158 |
| 92049 | 4/1938 | Sweden | 81/438 |

*Primary Examiner*—A. L. Pitts
*Assistant Examiner*—Henry W.H. Tsai
*Attorney, Agent, or Firm*—Schwartz & Weinrieb

[57] ABSTRACT

A method of securing sheet material to a support by means of a screw threaded fastener having a driving head adapted to drivably cooperate with a driving tool such that operation of the tool causes rotation of the fastener and enables the fastener to be driven into the support. The method is characterized in that a hole is formed through the sheet material by means of a drill bit attached to the driving tool so as to drivably cooperate with that tool in the same manner as the fastener drivably cooperates with the tool. The drill bit is removed from the tool after formation of the hole and is replaced by a fastener which is then driven into the support by the same tool so as to secure the sheet material to the support. The drill bit is characterized in that it has a drilling feature in the form of a substantially flat plate extending outwardly on each of two opposite sides of the rotational axis of the drill bit. A part of that plate disposed upon one side of the axis has a cutting edge and the corresponding edge of the plate part disposed upon the other side of the axis is positioned relative to the cutting edge so that it travels behind that edge during a hole drilling operation and provides a balancing influence.

23 Claims, 2 Drawing Sheets

ATTACHING SHEET MATERIAL TO A SUPPORT

FIELD OF THE INVENTION

This invention relates to a method of attaching sheet material to a support and also relates to apparatus for performing the method.

BACKGROUND OF THE INVENTION

A method according to the invention may be used for fixing sheets of roofing material to supports such as purlins or bearers and is particularly suitable for attaching sheet material having a high degree of expansion and contraction, such as polycarbonate or fiber reinforced plastics (for example, Suntuf sheets). It is to be understood however, that the method may be used for attaching other types of sheet material such as fibrous cement and fiberglass materials and other sheet materials used in the building industry. The invention will be hereinafter described with reference to a roofing application, but it is to be understood that the invention may be adopted for other purposes.

Sheets of polycarbonate roofing material are normally fixed to purlins by means of screw threaded fasteners and it is usual to preform holes in the sheets to permit passage of the fasteners. In order not to prevent movement of a sheet in directions transverse to the screws, as will occur when a sheet expands or contracts, it is usual for the holes to be oversized relative to the diameter of the shank of the screw fastener. Thus in a typical fixing operation, a workman must first drill an oversized hole in the sheet material and then pass a screw fastener through that hole and drive the fastener into the underlying purlin. Normally a workman has at hand a power drill and a power driver to carry out these two steps, but having two separate tools at hand is quite cumbersome. Although the same powered driving tool could possibly be used for both the drilling and the fastener driving steps, a different adaptor would need to be fitted to the driving tool for holding the drill bit and the fastener respectively. The need to exchange adaptors for that purpose would consume what might otherwise be productive time for the workman.

OBJECTS OF THE INVENTION

It is an object of the present invention to improve the economics of a roofing or other operation for attaching sheet material to a support by reducing unproductive time. It is a further object of the invention to provide a method of securing sheet material to a support which minimizes the range of equipment required to secure the sheet material in place and which minimizes time lost in non-productive activities. It is a further object of the invention to provide an improved drill bit for use in such a method.

SUMMARY OF THE INVENTION

A method in accordance with the invention is characterized in that the same driving tool adaptor is used to drive a drill bit and a fastener respectively. The drill bit is attached to the driving tool for the purpose of the hole forming operation after which it is removed and replaced by a fastener to be driven into the support by the driving tool so as to thereby secure the sheet material in place.

In accordance with one aspect of the invention there is provided a method of securing sheet material by a screw threaded fastener having a driving head adapted to drivably cooperate with a driving tool, wherein the method comprises the steps of:

attaching a drill bit to the driving tool so that the bit and the tool drivably cooperate in the same manner as the fastener and the tool drivably cooperate, operating the tool so as to rotate the bit about an axis thereof, applying the rotating bit to sheet material so as to drill a hole therethrough, removing the bit from the tool, attaching the fastener to the tool for drivable cooperation therewith, projecting the shank of the fastener through the hole, and operating the tool so as to drive the fastener into a support member and thereby secure the sheet material to the member.

It is preferred that the drill bit includes a cutting part and a balancing part which are located on respective opposite sides of the rotational axis. The cutting part is operative to form the hole through the sheet material and the balancing part is operative to enter the hole as it is being formed so as to thereby balance the drill bit during the hole forming operation. It is further preferred that the drill bit includes a shank having a driving head at one end and a drilling feature at the other. The driving head may have a hexagonal or other non-circular external configuration which fits within a socket of substantially complementary configuration forming part of the driving tool and in that way drivable cooperation between the driving tool and the drill bit is achieved. The configuration of the drill bit head is selected to be the same as that of the head of the fastener to be driven by the tool, or at least is so related to the fastener head configuration as to be capable of being driven by the same driving tool adaptor.

According to another aspect of the invention there is provided a drill bit including a shank, a driving head at one end of the shank, and a drilling feature at the other end of the shank, wherein the driving head has a configuration so as to be drivably cooperable with a driving tool adapted to drive a fastener having a head of substantially the same configuration.

The configuration of the drill bit driving head is preferably an external configuration which is adapted to fit within a socket of the driving tool, or an adaptor which is attachable to a driving tool, and cooperate with a substantially complementary configuration of that socket. By way of example, the configuration may be such as to include at least one flat surface which is engageable with a surface of the driving tool so as to effect the drivable cooperation, and in one particular example the configuration is generally hexagonal. It is further preferred that the drilling feature of the drill bit includes a cutting part located on one side of the rotational axis of the shank and a balancing part located on the opposite side of that shank. The cutting part is operative to form a hole in a member, such as a section of sheet material, and the balancing part is operative to enter the hole as it is being formed so as to thereby balance the drill bit during a hole forming operation. The cutting part preferably includes a cutting edge extending substantially transverse to the longitudinal axis of the drill bit shank and the balancing part preferably includes a further edge extending substantially transverse to the rotational axis. That further edge may be positioned relative to the cutting edge so as to travel behind the cutting edge when the drill bit is being used to drill a hole.

It is desirable that the drilling of a hole through the sheet material be accomplished as quickly as possible and for this reason a spade-type drill bit may be used. The present invention, in one particular embodiment, provides a specially configured spade-type drill bit for efficiently drilling holes through sheets of, for example, polycarbonate roofing material.

Preferably the drill bit has a spade-type cutting end which may include a lead or centering tip and a cutting edge extending from one side thereof to a lateral extremity of the spade end at which extremity there is provided a cutting tip. A second edge may extend from the other side of the centering tip to the other lateral extremity of the spade end. The second edge is preferably asymmetrical with respect to the cutting edge such that the cutting edge contacts and scours the material being drilled whereas the second edge does not have a cutting or drilling function, but assists in balancing the drill bit during a drilling operation. It has been found that an asymmetrical spade end drill bit as just described efficiently and effectively drills through sheets of polycarbonate and similar materials.

Usually the driving tool that is used for drilling an oversized hole in the sheet and then for driving a screw fastener into the support will be powered, for example electrically driven.

BRIEF DESCRIPTION OF THE DRAWINGS

An embodiment of the invention is described in detail in the following passages of the specification which refer to the accompanying drawings. The drawings, however, are merely illustrative of how the invention might be put into effect, so that the specific form and arrangement of the various features as shown is not to be understood as limiting the invention. In the drawings, like reference characters designate like or corresponding parts throughout the several views wherein.

DETAILED DESCRIPTION OF A PREFERRED EMBODIMENT

Figure 1:
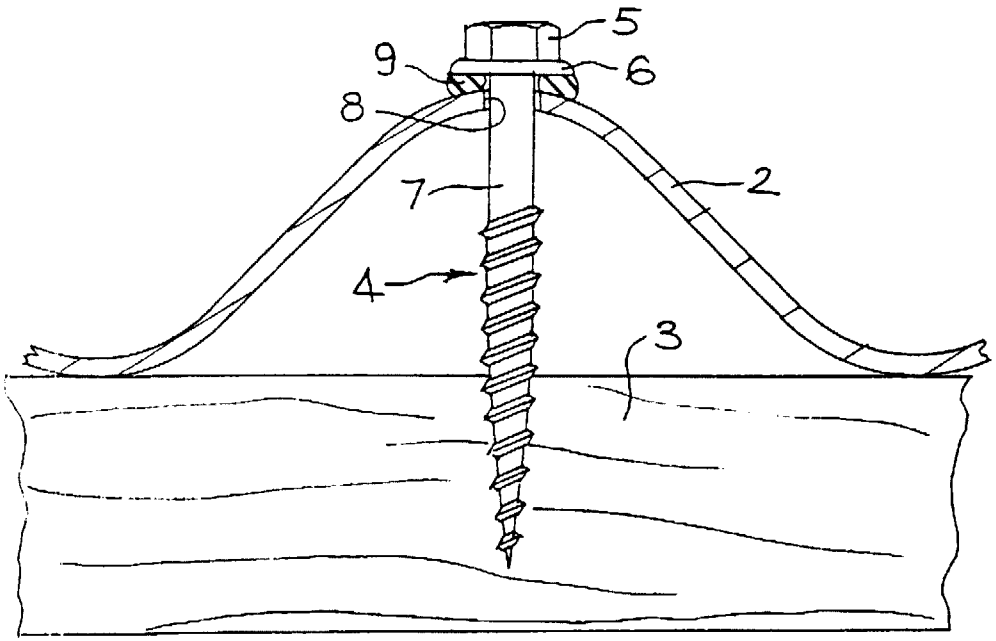
FIG. 1 is a partly cross sectioned view of a portion of sheet material secured to a support by a screw threaded fastener.

Referring now to the drawings, FIG. 1 shows a portion of a sheet of corrugated roofing material 2 which may be a polycarbonate sheeting. Such roofing material is usually corrugated and the corrugations may be of a form other than that which is illustrated. It is to be understood that the invention is applicable to the fixing of sheets that are not corrugated, for example trapezoid, and is not limited to use in roofing applications.

Sheet material 2 is fixed to a wood support 3, for example a purlin, by means of screw threaded fasteners 4, only one of which is shown, which pass through oversized holes 8 in the sheet 2 and are screwed into the support 3. In the example shown in FIG. 1 the fastener 4 is a hexagon head Type 17 screw, the head 5 of which includes an integral flange 6 formed at its underside. The under surface of the flange 6 may have a shallow recess (not shown) formed therein which extends to the shank 7 of the screw 4. It is to be understood that the invention is applicable to the fixing of sheet material to supports other than wood purlins such as a steel or other metal supports.

A neoprene washer 9 is provided around the shank 7 of screw 4 and seats in the above-mentioned shallow recess. Upon tightening of the screw 4, the washer 9 is squeezed between the under surface of flange 6 and the upper surface of sheet 2 so as to provide a sealing connection between these two surfaces and thereby closing off the hole 8 so as to prevent leakage of water through the sheet 2. Sealing washers of the foregoing kind are usually specifically designed to suit polycarbonate material and allow for movement of the sheet.

In order to fix the sheet 2 to the purlin 3, holes 8 must first be drilled through the sheet 2.

Figure 2:
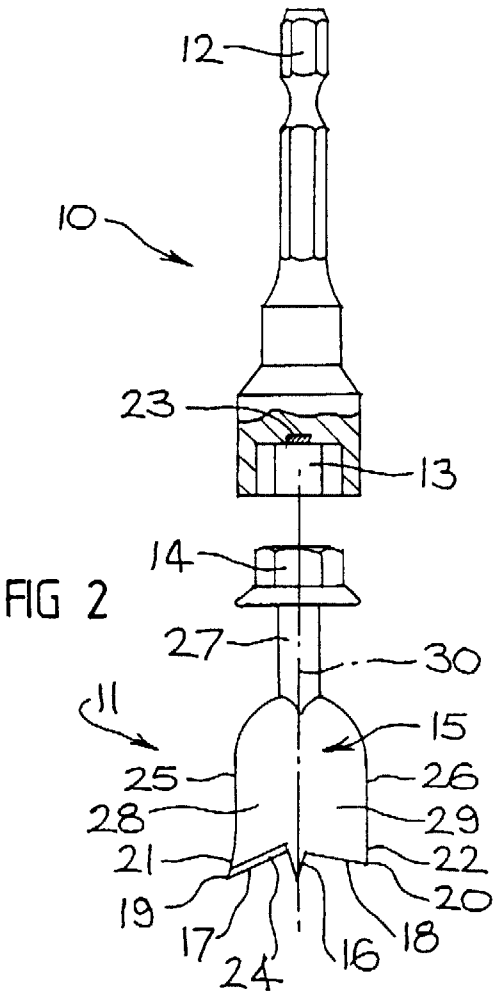
FIG. 2 is an elevation view which shows a spade end drill bit and a partly sectioned adaptor for attaching the drill bit to a driving tool.
Figure 4:
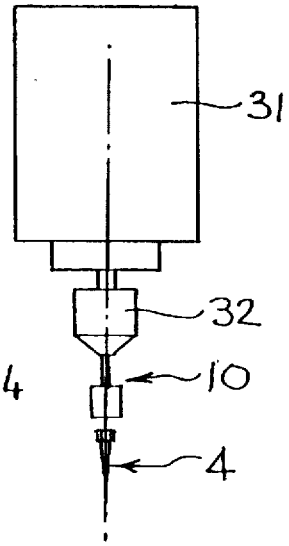
FIG. 4 is a diagrammatic view of a driving tool and a fastener adapted to cooperate with that tool.

In the example shown in FIG. 2 a drill bit 11 is attached to a driving tool 31 as shown in FIG. 4, by way of a cooperable adaptor 10 which is releasably attachable to the tool 31. It is to be understood that the drill bit could be attached directly to a driving tool or in some other manner not requiring a removable adaptor.

The particular adaptor 10 shown in FIG. 2 is of the well known "snap lock" type having a drive shaft 12 adapted for insertion into a suitable chuck 32 of a powered driving tool 31 as seen in FIG. 4. The drive shaft 12 cooperates with the tool chuck 32 in such a manner as to permit the shaft 12 to be driven so as to rotate about its longitudinal axis when the associated driving tool 31 is operated. A socket 13 is provided at the end of the shaft 12 remote from the chuck 31, and in the example shown that socket is of a generally hexagonal shape in transverse cross-section. The size and form of that socket 13 is predetermined to suit the size and form of the fastener head 5 so that there is cooperable driving engagement between the adaptor 10 and the fastener 4 such that operation of the driving tool 31 causes rotation of the fastener 4 about the longitudinal axis of the shank 7.

It is to be understood that a different socket configuration could be adopted for fasteners having a driving head different than that of the fastener 4. Also, the adaptor 10 may have an external driving configuration rather than an internal configuration as represented by the socket 13, and in those circumstances a socket of substantially complementary configuration will be provided in the fastener head 5.

Means may be provided for releasably retaining the fastener 4 in the adaptor 10, and for that purpose a small magnet 23 may be fixed on or inserted in the inner end surface of socket 13.

FIG. 2 shows an exemplary drill bit 11 designed for use with the adaptor 10. The drill bit 11 has a driving head 14 at one end of a shank 27 and a drilling feature 15 at the other end of the shank. The driving head 14 is of substantially the same shape and size as the head 5 of the fastener 4 and consequently is able to drivably cooperate with the socket 13. It is to be appreciated however, that the driving head 14 could be of a form different to that shown and nevertheless be able to drivably cooperate with the socket 13.

In the example shown, the drilling feature 15 is of a spade or plate-like form and extends substantially radially with respect to the longitudinal axis of the shank 27 on both sides of that shank. A lead or centering tip 16 of narrow pointed form is provided at the center of the drilling feature 15 and extends in the longitudinal direction of the shank 27. The centering tip 16 is arranged so as to be the first part of the drilling feature 15 to contact a member to be drilled by the drill bit 11.

One part 28 of the drilling feature 15 forms a cutting part and another part 29 forms a balancing part. The parts 28 and 29 are disposed on opposite sides of the shank 27 as shown. A cutting edge 17 is provided at the lower extremity of the part 28 and extends generally transverse to the rotational axis of the bit 11. It is preferred as shown that the edge 17 slopes outwardly from the rotational axis in a direction away from the head 14. The cutting edge 17 may be made sharp by bevelling as shown by reference 24. A second edge 18 forms the lower extremity of the other part 29 and may also slope in generally the same manner as the edge 17. The radially outer end 19 of the edge 17 and the radially outer end 20 of the edge 18 are preferably substantially the same radial distance from the bit axis 30. It is further preferred as shown that the cutting edge 17 is positioned lower than the second edge 18 so as to lead the edge 18 during a drilling operation and scour the material being drilled to form a hole 8. The second edge 18 of the particular construction shown does not perform a cutting operation, but balances the drill bit 11 and thus the cutting and scouring process.

The drilling feature 15 of the drill bit 11 as shown is provided with substantially parallel outer edge portions 25 and 26 to facilitate removal of the bit from the hole 8 after completion of a drilling operation.

Figure 3:
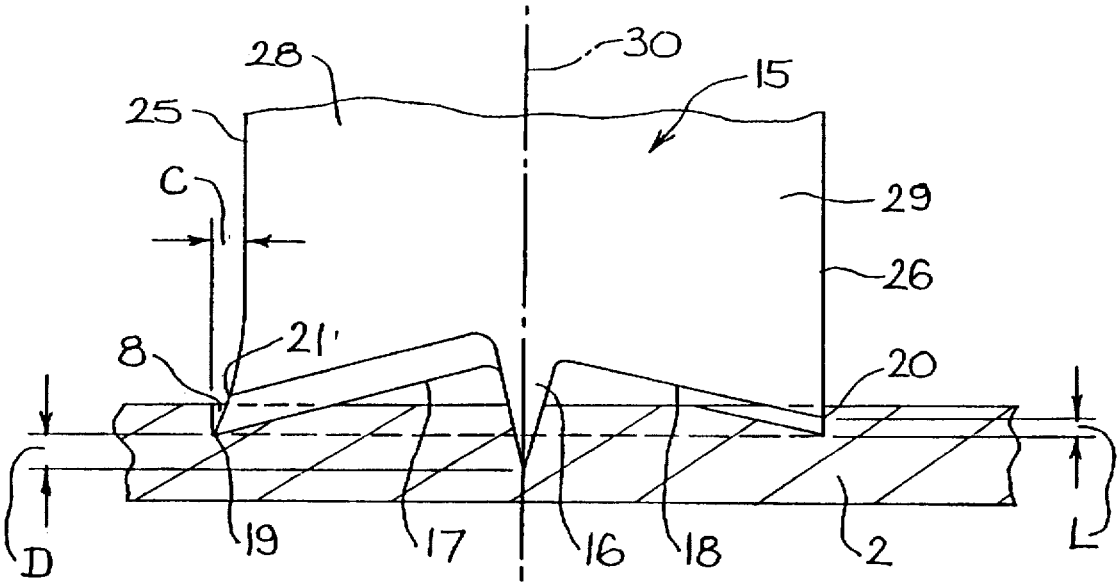
FIG. 3 is a partly sectioned view which shows the drilling end of the drill bit on an enlarged scale and penetrating a portion of sheet material.

FIG. 3 shows the operative part of the drilling feature 15 on an enlarged scale and therefore in greater detail. In the preferred arrangement shown, the outer side edge of the part 28 is curved inwards along section 21 so as to create a relatively sharp cutting tip at the edge end 19 and also create a clearance C behind that end 19. FIG. 3 also shows the edge 18 lagging behind the cutting edge 17 by a distance L in the axial direction so that it does not contribute to the cutting action. On the other hand the distance L is preferably predetermined so that the edge end 20 enters the hole 8 shortly after commencement of the formation of that hole and thereby provides a balancing influence which promotes formation of a truly circular hole 8.

The curved section 21 and the clearance C can be omitted without significantly disturbing the operation of the drill bit 11. It has been found in practice that the drill bit 11 functions satisfactorily if the edges 25 and 26 remain substantially parallel to the lower edge ends 19 and 20.

It is also apparent from FIG. 3 that the centering tip 16 leads the cutting edge 17 by a distance D in the axial direction and thereby enables the tip 16 to keep the drill bit 11 centered during a drilling operation.

During performance of the method, the drill bit 11 is first attached to the adaptor 10, which is attached to the powered tool 31, so as to be conditioned to drill a hole 8. The small magnet 23 within the socket 13 retains the bit 11 in position on the adaptor 10. After the hole 8 has been drilled, the bit 11 is manually removed from adaptor 10 and a screw fastener 4 is inserted within the adaptor 10 in its place. The power tool 31 is then positioned to project the screw 4 through the hole 8 and is operated to drive the screw 4 into the support 3.

The drill bit 11 is preferably made from a screw blank comprising a cylindrical shank 27 and a head 14. The drilling feature 15 may be made by pressing or stamping an end portion of the shank 27 using appropriately shaped dies, and the shaped blank may then be heat treated to increase its strength. Other methods of forming the drill bit may be adopted.

The invention described herein is susceptible to variations, modifications and/or additions other than those specifically described and it is to be understood that the invention includes all such variations, modifications and/or additions which fall within the spirit and scope of the appended claims. It is therefore to be understood that within the scope of the appended claims, the present invention may be practiced otherwise than as specifically described herein.

Having now described our invention, what we claim as new and desire to secure by Letters Patent:

1. A method of securing sheet material to a substrate, comprising the steps of:

providing a driving tool with a first drive connection means having a first predetermined size and configuration;

providing a drill bit with a second drive connection means having a second predetermined size and configuration which is substantially the same as said first predetermined size and configuration of said first drive connection means of said driving tool such that said second drive connection means of said drill bit can drivingly mate with said first drive connection means of said driving tool when said drill bit is mounted upon said driving tool so that said drill bit can be driven by said driving tool as a result of a drive connection defined between said first drive connection means of said driving tool and said second drive connection means of said drill bit;

providing a fastener, having a head portion, a shank portion, and a tip portion, with a third drive connection means having a third predetermined size and configuration which is substantially the same as said first predetermined size and configuration of said first drive connection means of said driving tool such that said third drive connection means of said fastener can drivingly mate with said first drive connection means of said driving tool when said fastener is mounted upon said driving tool so that said fastener can be driven by said driving tool as a result of a drive connection defined between said first drive connection means of said driving tool and said third drive connection means of said fastener;

providing means operative for releasably retaining said drill bit attached within said driving tool;

mounting said drill bit upon said driving tool by mating said second drive connection means of said drill bit with said first drive connection means of said driving tool;

operating said driving tool so that said drill bit is rotated about an axis thereof and applying said rotating drill bit to sheet material so as to drill a hole through said sheet material;

removing said drill bit from said driving tool after said hole is drilled within said sheet material;

mounting said fastener upon said driving tool by mating said third drive connection means of said fastener with said first drive connection means of said driving tool;

projecting said shank portion of said fastener through said hole drilled within said sheet material by said drill bit so that said tip portion of said fastener engages a substrate; and operating said driving tool so that said fastener is driven about an axis thereof and into said substrate until said head portion of said fastener engages said sheet material so as to secure said sheet material to said substrate.

2. A method according to claim 1, further comprising the step of:

providing said drill bit with a cutting part and a balancing part which are located on respective opposite sides of said rotational axis and wherein said cutting part is operative to form said hole within said sheet material and said balancing part is operative to enter said hole as it is being formed within said sheet material so as to thereby balance said drill bit during the formation of said hole within said sheet material.

3. A method according to claim 2, further comprising the step of:

providing said cutting part and said balancing part upon said drill bit such that each extends substantially the same distance radially outwardly from said rotational axis of said drill bit.

4. A method according to claim 1, further comprising the step of:

providing said drill bit with a shank and drilling structure at one end of said shank, a cutting edge of said drilling structure being located on one side of said rotational axis and extending outwardly therefrom, an additional edge of said drilling structure being located on the side of said rotational axis which is opposite said one side and extending outwardly from said axis, and wherein said additional edge of said drilling structure is positioned relative to said cutting edge of said drilling structure so as to trail behind said cutting edge of said drilling structure during said drilling step.

5. A method according to claim 1, further comprising the step of:

providing said drill bit with drilling structure at one end of a shank portion of said drill bit wherein said drilling structure includes a substantially flat blade having a cutting edge extending substantially transverse to the rotational axis of said drill bit and is located remote from the other end of said shank portion of said drill bit.

6. A method according to claim 5, further comprising the step of:

providing said cutting edge upon said substantially flat blade of said drilling structure such that said cutting edge slopes outwardly from said axis of rotation of said drill bit in a direction away from said other end of the shank portion of said drill bit.

7. A method according to claim 5, further comprising the step of:

providing said cutting edge of said flat blade of said drill bit upon one side of said rotational axis of said drill bit, and an additional edge upon said blade such that said additional edge extends substantially transverse to said rotational axis and is located on the side of said rotational axis which is opposite to said one side.

8. A method according to claim 7, further comprising the step of:

providing said additional edge upon said blade such that said additional edge is located closer to said other end of the shank than is said cutting edge.

9. A method according to claim 1, further comprising the steps of:

providing said third drive connection means of said fastener head with a non-circular shape in cross-section transverse to the longitudinal axis of the fastener whereby said non-circular shape enables said drivable cooperation between the fastener and the driving tool; and providing said tool bit with a driving head which comprises said second drive connection means and which has substantially the same shape in cross-section transverse to said rotational axis as that of said fastener head.

10. A method according to claim 1, further comprising the step of:

providing said retaining means in the form of a magnet disposed upon said driving tool.

11. A method according to claim 1, wherein said step of mounting said fastener upon said driving tool comprises the step of:

inserting said fastener head within a socket of said driving tool and thereby drivably cooperate with the driving tool so as to be restrained against relative rotation with respect to said driving tool about the longitudinal axis of the fastener.

12. A method according to claim 1, further comprising the step of:

making the diameter of said hole within said sheet material larger than the maximum diameter of the shank of said fastener.

13. A driving tool assembly, comprising:

a driving tool comprising a first drive connection means having a first predetermined size and configuration;

a drill bit comprising a shank portion, drilling structure disposed upon one end of said shank portion, and a driving head disposed upon an opposite end of said shank portion and comprising a second drive connection means, having a second predetermined size and configuration which is substantially the same as said first predetermined size and configuration of said first drive connection means of said driving tool such that said second drive connection means of said drill bit can drivingly mate with said first drive connection means of said driving tool, for establishing a drive connection with said first drive connection means of said driving tool when said drill bit is mounted upon said driving tool so that said drilling structure of said drill bit can drill a hole within a member to be attached to a substrate when said drill bit is driven by said driving tool as a result of said drive connection established between said first drive connection means of said driving tool and said second drive connection means of said drill bit; and a fastener comprising a shank portion, a tip portion disposed upon one end of said shank portion, and a driving head disposed upon an opposite end of said shank portion and comprising a third drive connection means having a third predetermined size and configuration which is substantially the same as said first predetermined size and configuration of said first drive connection means of said driving tool such that said third drive connection means of said fastener can drivingly mate with said first drive connection means of said driving tool, for establishing a drive connection with said first drive connection means of said driving tool when said fastener is mounted upon said driving tool so that said shank portion of said fastener can be inserted through the hole formed within the member by said drill bit and said tip portion of said fastener can be inserted into the substrate, when said fastener is driven by said driving tool as a result of said drive connection established between said first drive connection means of said driving tool and said third drive connection means of said fastener, so as to secure the member to the substrate;

means operative for releasably retaining said drill bit attached within said driving tool;

whereby said drill bit and said fastener can be alternatively attached to the same driving tool when a drilling operation and a fastening operation are to be respectively performed.

14. A driving tool assembly according to claim 13, wherein:

said predetermined configuration of said fastener driving head and said drill bit driving head comprises an external configuration which is adapted to fit within and cooperate with a socket formed within said driving tool and having a substantially complementary configuration.

15. A driving tool assembly according to claim 14, wherein:

said predetermined configuration of the driving head of said fastener and said drill bit driving head is the cross-sectional shape of the respective driving head transverse to the longitudinal axis of the respective shank portion, and said shape is non-circular.

16. A driving tool assembly according to claim 15, wherein:

said shape includes at least one flat surface which is engageable with a surface of said driving tool to effect said drivable connection.

17. A driving tool assembly according to claim 15, wherein said shape is generally hexagonal.

18. A driving tool assembly according to claim 13, wherein:

said drilling structure includes a cutting part located on one side of the longitudinal axis of said shank portion and a balancing part located on the opposite side of said longitudinal axis, said cutting part being operative to form the hole within the member and said balancing part is operative to enter said hole as it is being formed so as to thereby balance said drill bit during the hole forming operation.

19. A driving tool assembly according to claim 18, wherein:

said cutting part includes a cutting edge extending substantially transverse to the longitudinal axis of said shank portion, said balancing part includes an additional edge extending substantially transverse to said longitudinal axis, and said additional edge is positioned relative to said cutting edge so as to travel behind the cutting edge when the drill bit is being used to drill a hole.

20. A driving tool assembly according to claim 19, wherein:

each one of said edges slopes outwardly from said longitudinal axis of said drill bit in a direction away from said driving head of said drill bit.

21. A driving tool assembly according to claim 19, wherein:

the radially outer end of said cutting edge is positioned radially outwards of said longitudinal axis of said drill bit by a distance greater than the radially outward distance of an adjacent non-cutting section of said cutting part.

22. A driving tool assembly according to claim 19, wherein:

the radially outer end of each one of said edges is positioned substantially the same radial distance from said longitudinal axis of said drill bit.

23. A driving tool assembly according to claim 13, wherein:

said drilling structure includes a centering tip located upon said longitudinal axis of said drill bit and extending in the direction of said longitudinal axis so as to contact the member to be drilled before any other part of said drilling structure.

* * * * *